US006675859B2

(12) United States Patent
Nien

(10) Patent No.: US 6,675,859 B2
(45) Date of Patent: Jan. 13, 2004

(54) CURTAIN AND VENETIAN BLIND ARRANGEMENT

(75) Inventor: Ming Nien, Changhua Hsien (TW)

(73) Assignee: Nien Made Enterprise Co., Ltd. (TW)

( * ) Notice: Subject to any disclaimer, the term of this patent is extended or adjusted under 35 U.S.C. 154(b) by 0 days.

(21) Appl. No.: 10/180,530

(22) Filed: Jun. 27, 2002

(65) Prior Publication Data

US 2003/0213565 A1 Nov. 20, 2003

(30) Foreign Application Priority Data

May 16, 2002 (TW) ..... 91206986 U

(51) Int. Cl.[7] ..... E06B 9/26
(52) U.S. Cl. ..... 160/89; 160/178.1 R
(58) Field of Search ..... 160/168.1 R, 178.1 R, 160/236, 89, 84.05, 173 R

(56) References Cited

U.S. PATENT DOCUMENTS 1,937,342 A * 11/1933 Higbie ..... 160/236
2,110,145 A * 3/1938 Loehr ..... 160/89
2,914,122 A * 11/1959 Pinto ..... 160/89
2,994,370 A * 8/1961 Pinto ..... 160/89
3,386,490 A * 6/1968 Kandel ..... 160/236
4,951,729 A * 8/1990 Chi Yu ..... 160/236 X
4,984,617 A * 1/1991 Corey ..... 160/89 X
5,490,553 A * 2/1996 Colson et al. ..... 160/89 X
5,829,506 A * 11/1998 Zorbas ..... 160/236

* cited by examiner

*Primary Examiner*—David Purol
(74) *Attorney, Agent, or Firm*—Bacon & Thomas, PLLC

(57) ABSTRACT

A curtain and Venetian blind arrangement. The arrangement includes a Venetian blind formed of a headrail, a bottom rail, a set of slats, and a lift cord set adapted for joining the headrail, the bottom rail and the slats and keeping the slats arranged between the headrail and the bottom rail. Curtains are coupled to the slats, with each curtain having at least one peripheral side suspended from one slat. At least one peripheral side of each curtain is mounted with at least one weight.

9 Claims, 9 Drawing Sheets

CURTAIN AND VENETIAN BLIND ARRANGEMENT

BACKGROUND OF THE INVENTION

1. Field of the Invention

The present invention relates to Venetian blinds and, more specifically, to a curtain and Venetian blind arrangement, which comprises a Venetian blind, and a number of curtains mounted with weights and respectively suspended from the slats at different elevations.

2. Description of the Related Art

In order to enhance the light blocking effect and decorate the blind, the inventor of the present invention invented various Venetian blinds with detachable curtain. However, these curtain and Venetian blind arrangements are still not satisfactory in function. When receiving the blind, the curtain tends to be jammed in between the slats and wrinkled. When the border area of the curtain curved or wrinkled, the sense of beauty of the curtain is destroyed, and the curtain cannot completely block the light.

SUMMARY OF THE INVENTION

The present invention has been accomplished to provide a curtain and Venetian blind arrangement, which eliminates the aforesaid drawbacks. It is the main object of the present invention to provide a curtain and Venetian blind arrangement, which enables the curtains to be smoothly suspended from the slats.

It is another object of the present invention to provide a curtain and Venetian blind arrangement, which prohibits the curtains from been jammed in between the slats during receiving of the Venetian blind.

It is still another object of the present invention to provide a curtain and Venetian blind arrangement, which prevents the curtains from flying in the wind.

To achieve these objects of the present invention, the curtain and Venetian blind arrangement comprises a Venetian blind formed of a headrail, a bottom rail, a set of slats, and a lift cord set adapted for joining the headrail, the bottom rail and the slats and keeping the slats arranged between the headrail and the bottom rail, and a plurality of curtains coupled to the slats, each curtain having at least one peripheral side suspended from one slat. The at least one peripheral side of each curtain is mounted with at least one weight.

DETAILED DESCRIPTION OF THE PREFERRED EMBODIMENT

Figure 1:
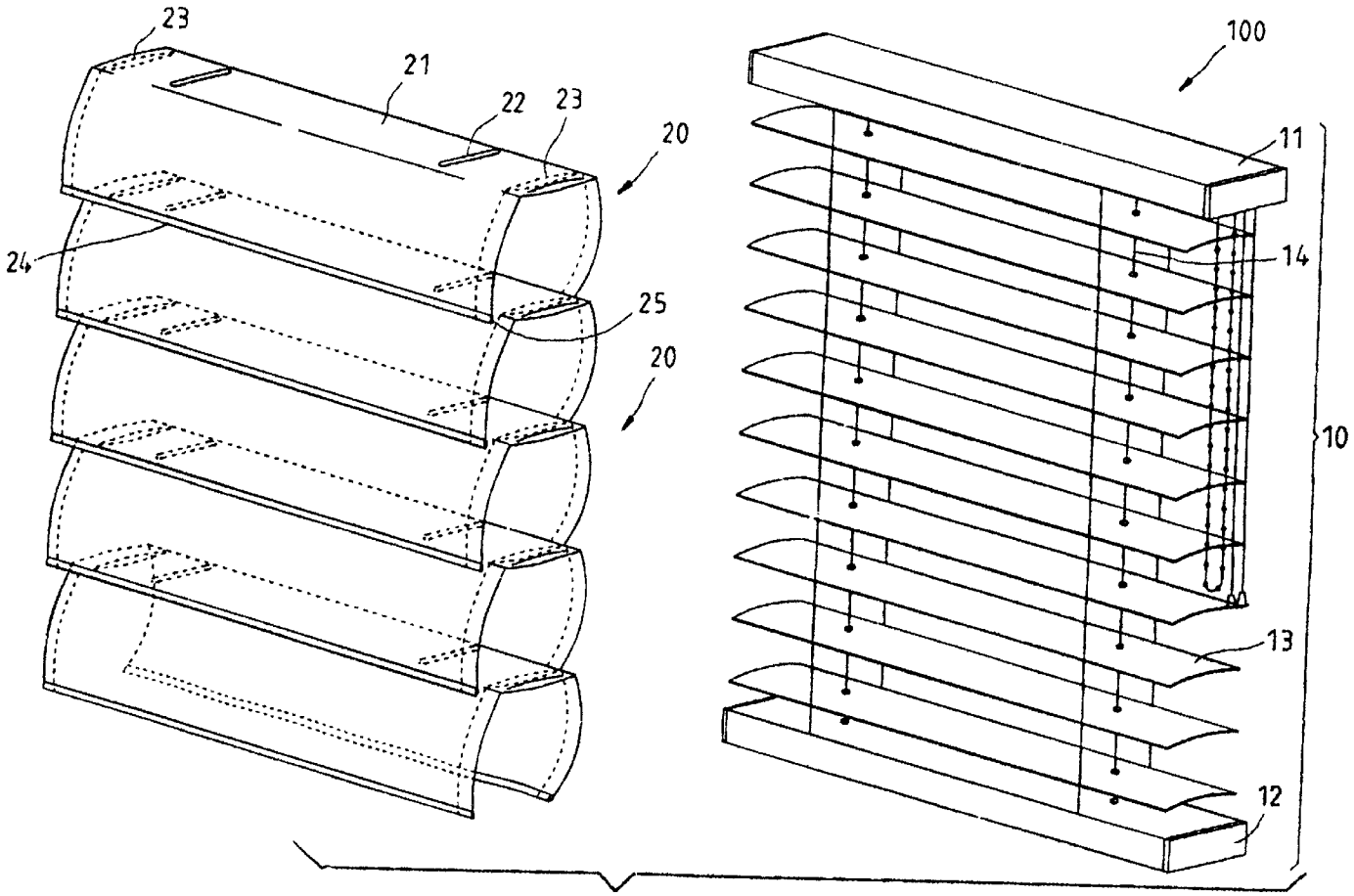
FIG. 1 is an exploded view of a curtain and Venetian blind arrangement constructed according to a first embodiment of the present invention.

Referring to FIGS. from 1 through 5, a curtain and Venetian blind arrangement 100 in accordance with a first embodiment of the present invention is shown comprised of a Venetian blind 10, a number of curtains 20, and a number of weights 30.

Referring to FIGS. from 1 through 4, the Venetian blind 10 comprises a headrail 11, a bottom rail 12, a number of slats 13, and a lift cord set 14. The headrail 11 is fixedly fastened to the top side of the window. The bottom rail 12 is spaced below the headrail 11. The slats 13 are arranged in parallel between the headrail 11 and the bottom rail 12. The lift cord set 14 is adapted to join the headrail 11, the bottom rail 12 and the slats 13, for enabling the bottom rail 12 and the slats 13 to be lifted or lowered relative to the headrail 11 to the desired elevation.

Figure 2:
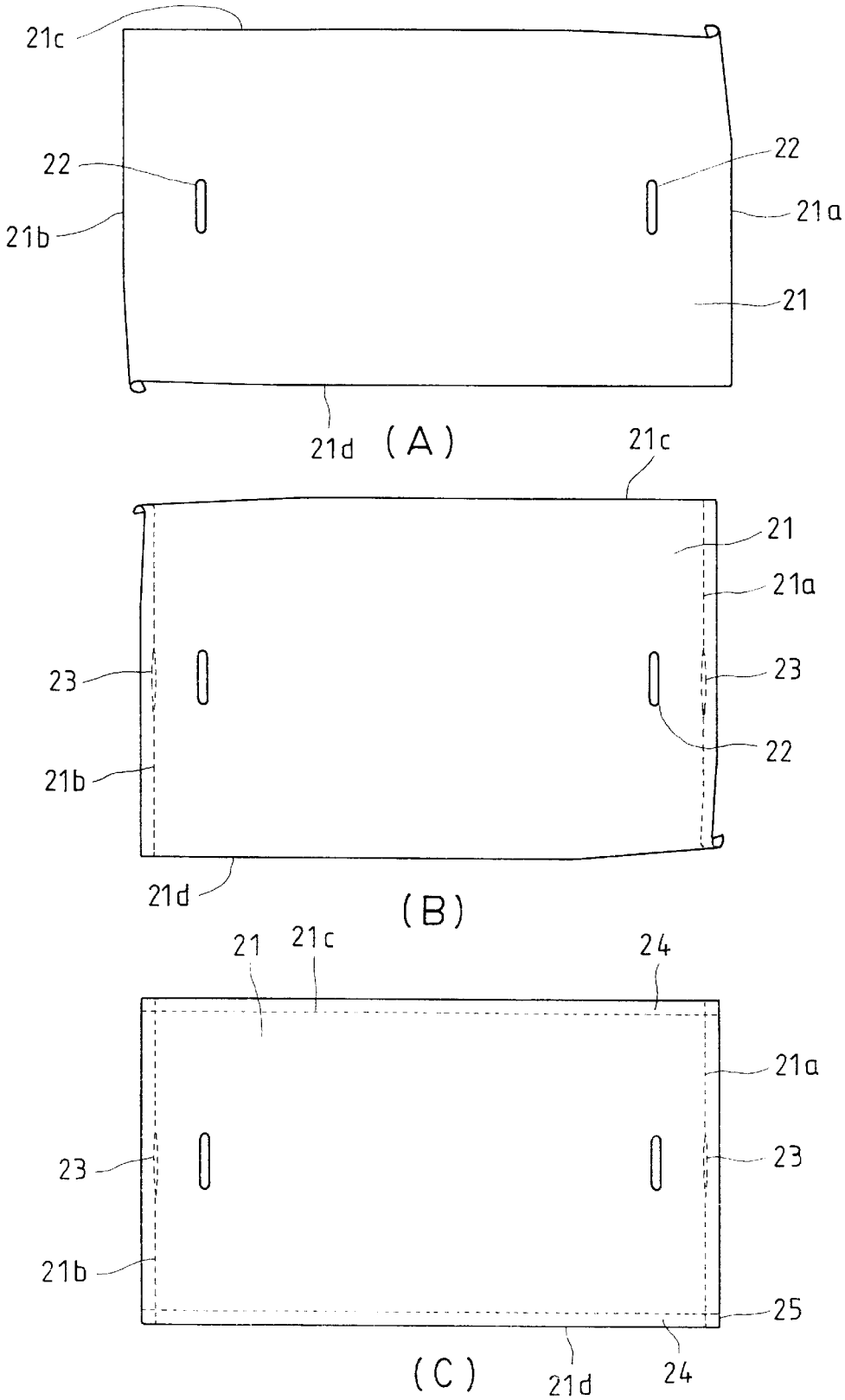
FIG. 2 is a curtain fabrication flow according to the present invention.
Figure 3:
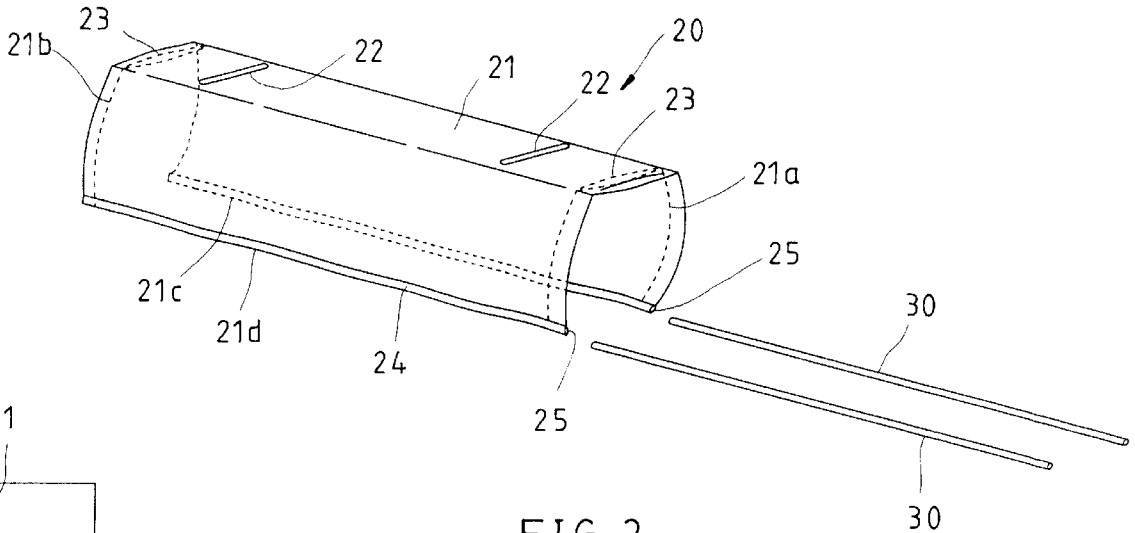
FIG. 3 is an exploded view of a part of FIG. 1.

Referring to FIGS. 1, 2, and 3, the number of curtains 20 is one half of the number of the slats 13, each comprised of a curtain body 21 made of silk, cotton, nylon, or any of a variety of natural or synthetic fabrics. The curtain body 21 comprises two through holes 22 for the passing of the lift cord set 14 (see FIG. 2A), a first peripheral side 21*a*, a second peripheral side 21*b* opposite to the first peripheral side 21*a*, a third peripheral side 21*c* connected between the first peripheral side 21*a* and the second peripheral side 21*b* at one side, and a fourth peripheral side 21*d* connected between the first peripheral side 21*a* and the second peripheral side 21*b* at one side opposite to the third peripheral side 21*c*. The border areas of the first and second peripheral sides 21*a*;21*b* are respectively folded inwards to a predetermined distance and then bilaterally stitched to the respective curtain body 21, forming a respective pocket 23 (see FIG. 2B). The width of the pocket 23 is approximately equal to the width (transverse length) of the minor axis of the slats 13. The border areas of the third and fourth peripheral sides 21*c*;21*d* are respectively folded inwards to a predetermined distance and then stitched to the respective curtain body 21, forming a respective pocket 24 (see FIG. 2C). The depth of the pocket 24 is approximately equal to the length (longitudinal length) of the slats 13. The pocket 24 has at least one opening 25 in one end.

Referring to FIG. 3, the weights 30 are heavy rod members, having the length approximately equal to the depth of the pockets 24 of the curtains 20, i.e., approximately equal to the longitudinal length of the slats 13. Therefore, the weights 30 can be inserted through the openings 25 of the curtains 20 into the respective pockets 24, maintained secured to the third and fourth sides 21*c*;21*d* of the curtains 20.

The installation procedure of the aforesaid first embodiment is outlined hereinafter.

Figure 4:
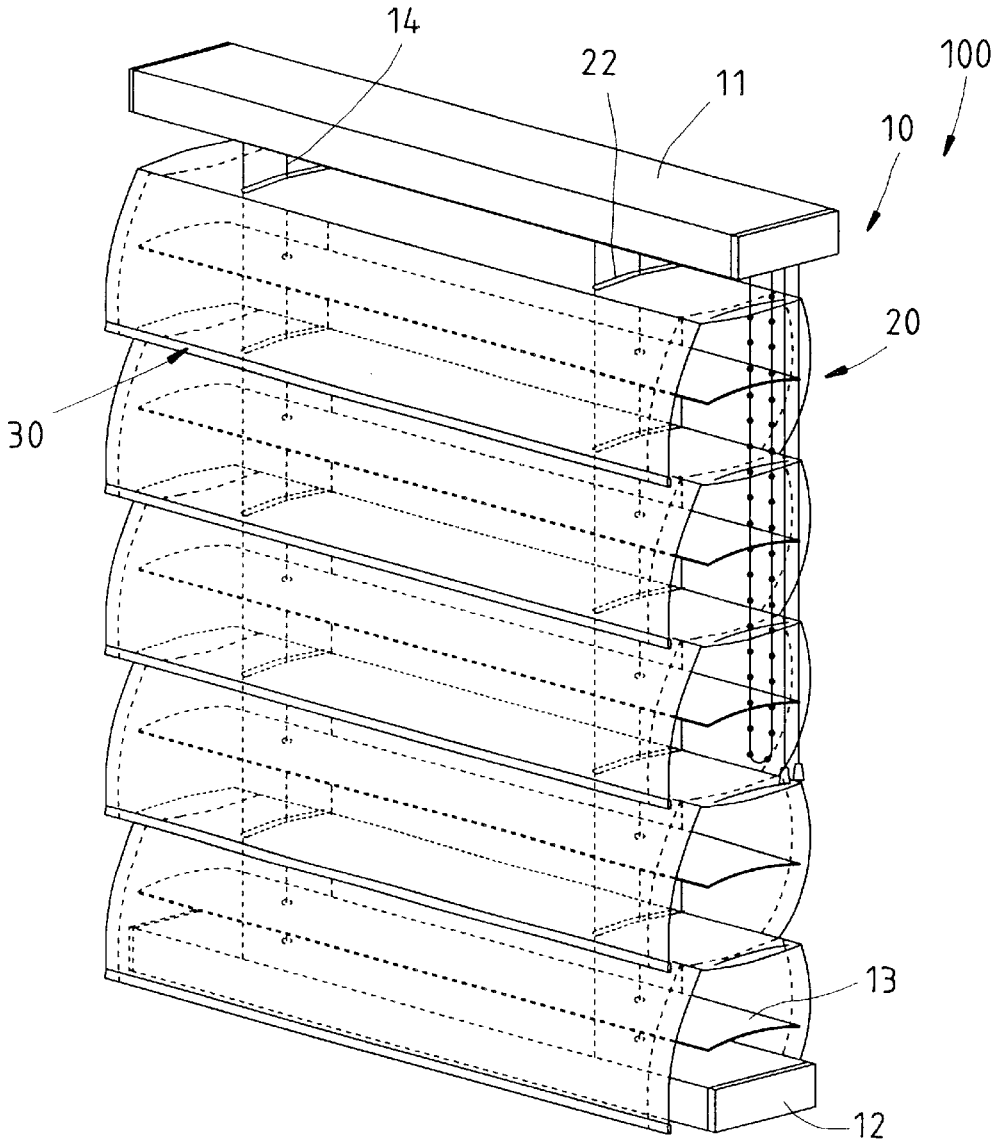
FIG. 4 is a perspective assembly view of the first embodiment of the present invention.

Before the installation of the Venetian blind 10, the lift cord set 14 is inserted through the through holes 20 of the curtains 20, keeping the curtains 20 respectively covered on the odd number slats 13 (the first, third, fifth, seventh . . .

slats), and then the respective two ends of the odd number slats 13 are respectively inserted into the pockets 23 at the first peripheral sides 21*a* and second peripheral sides 21*b* of the curtains 20, keeping the curtain bodies 21 respectively secured to the slats 13. At this time, the weights 30 impart a downward pressure to the pockets 24 of the curtain bodies 21. When the slats 13 maintained in horizontal, the suspension distance of the third peripheral side 21*c* and fourth peripheral side 21*d* of each curtain 20 is greater than the pitch between two curtains 20. According to this embodiment, the suspension distance of the third peripheral side 21*c* and fourth peripheral side 21*d* of each curtain 20 is greater than the distance of three slats 13 (the suspension distance of the third peripheral side 21*c* and fourth peripheral side 21*d* of the curtain body 21 of the curtain 20 at the first slat 13 is over the position of the third slat 13). Because of the weight of the weights 30, the third and fourth peripheral sides 21*c*;21*d* are pulled downwards in vertical, as shown in FIG. 4, to block the gaps between each two adjacent slats 13 and to stop light from passing through the gaps. Further, the weights 30 stabilize the suspension portions of the curtains 20, preventing the suspension portions from flying in the wind. Therefore, the weights 30 stabilize the suspension of the curtain bodies 21 of the curtain 20, enhancing the light blocking effect of the Venetian blind 10.

Figure 5:
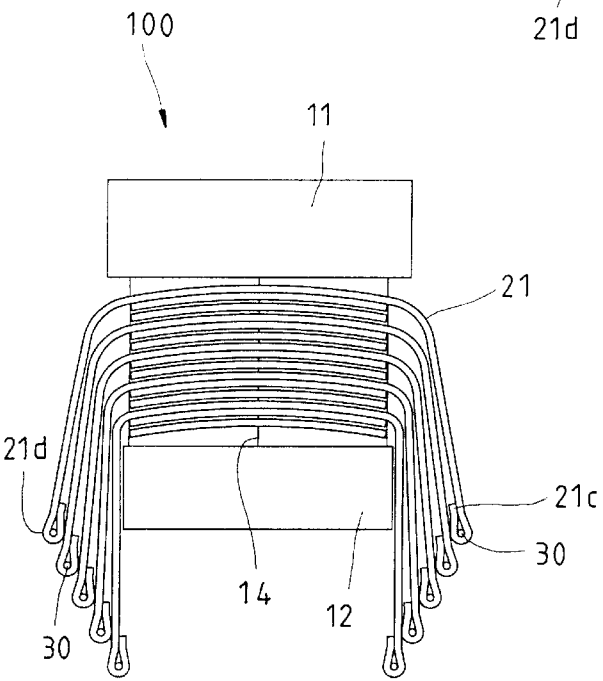
FIG. 5 is a side view showing the received status of the first embodiment of the present invention.

The arrangement of the weights 30 shortens the variation of pitch between the slats 13 when operating the lift cord set 14 to lift the slats 13 and the bottom rail 12. During the variation of pitch, the weights 30 stabilize the free ends of the third and fourth peripheral sides 21*c*;21*d*, preventing flying of the curtains 20 in the wind and jamming of the curtain bodies 21 in between the slats 13, and therefore the curtains 20 are well arranged in a stack when received (see FIG. 5).

Figure 6:
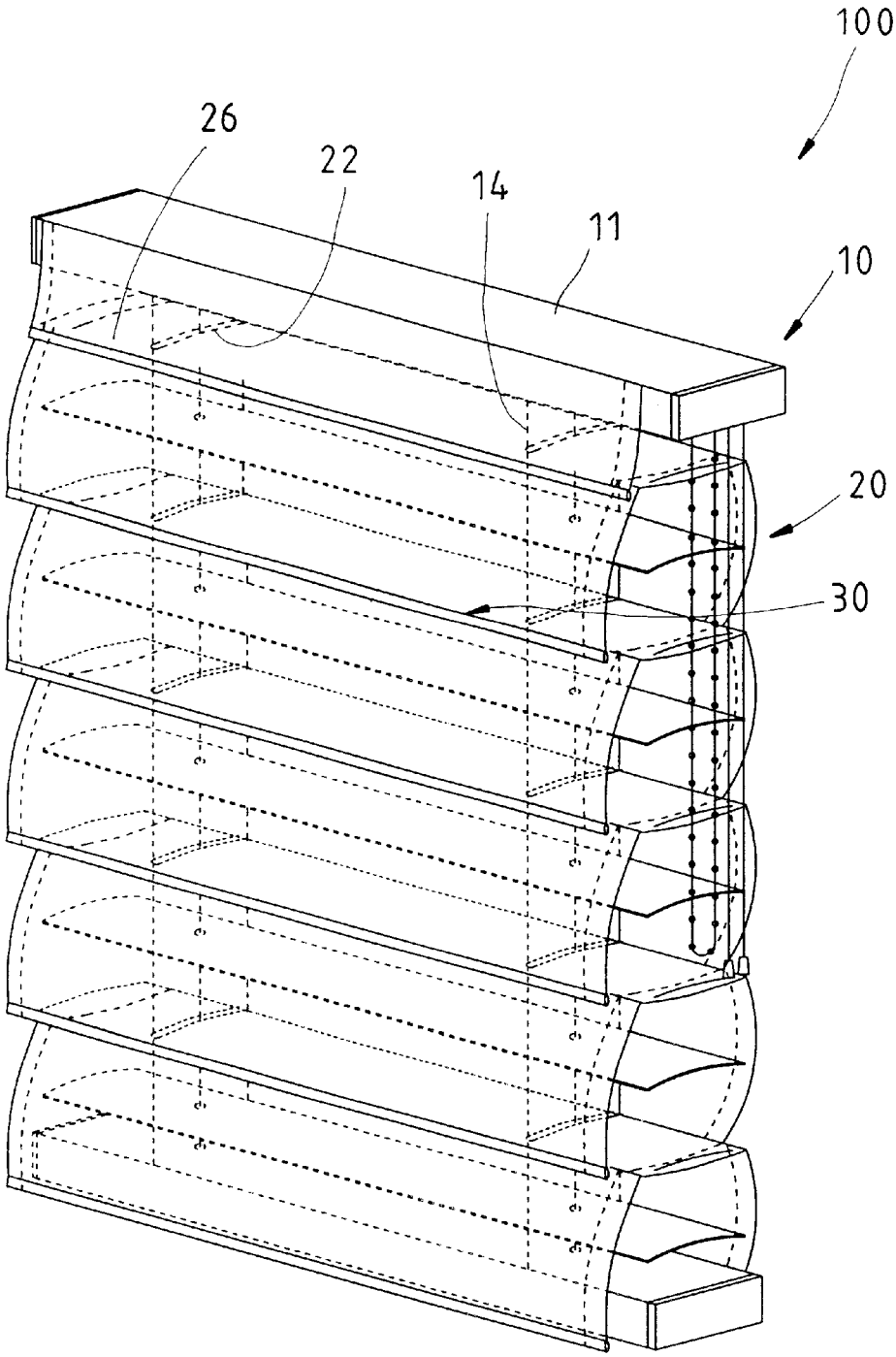
FIG. 6 is a perspective view showing the first embodiment of the present invention attached with an ornamental curtain.

Referring to FIG. 6, an ornamental curtain 26 may be attached to the curtains 20 to decorate the whole assembly of the assembly of the curtain and Venetian blind arrangement 100 and to block the gap between the headrail 11 and the first slat 13. The decorative curtain 26 may also be equipped with weights 30.

In the aforesaid embodiment, the pull end of the lift cord set 14 of the Venetian blind 10 is exposed to the outside for operation. Alternatively, the Venetian blind 10 can be made having means to keep the lift cord set 14 from sight and out of reach of children.

As indicated above, the invention achieves the following advantages:

1. Better slat receiving status:

Because of the effect of the weights, the curtains are smoothly suspended from the slats at two sides, enabling the slats to be received smoothly without wrinkling the curtains.

2. Eliminating curving of the curtains:

The weights pull the curtains bilaterally downward, keeping the curtains stably suspended from the slats and preventing the curtains from flying in the wind or being jammed in the slats.

Figure 7:
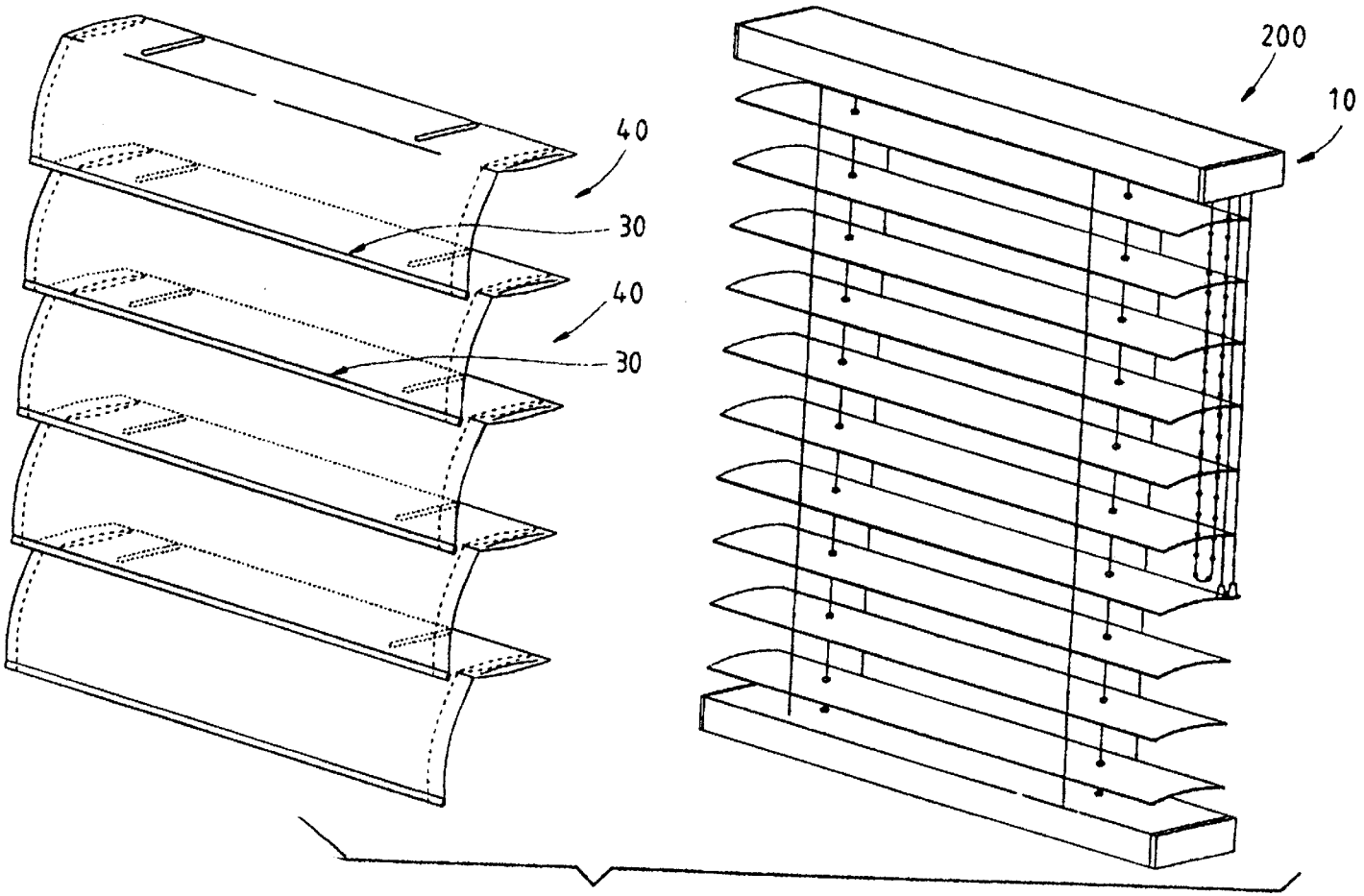
FIG. 7 is an exploded view of a curtain and Venetian blind arrangement constructed according to a second embodiment of the present invention.

FIG. 7 shows a curtain and Venetian blind arrangement 200 according to a second embodiment of the present invention. Similar to the aforesaid first embodiment of the present invention, the curtain and Venetian blind arrangement 200 is comprised of a Venetian blind 10, a number of curtains 40, and a number of weights 30. Unlike the aforesaid first embodiment of the present invention, the curtains 40 each have only one side (the third or fourth side) suspended from the slats 13 and one weight 30 provided in the suspended side. This arrangement diminishes the consumption of curtain material, and reduces the number of the weights 30 required. Therefore, the manufacturing cost of this arrangement is relatively reduced.

Figure 8:
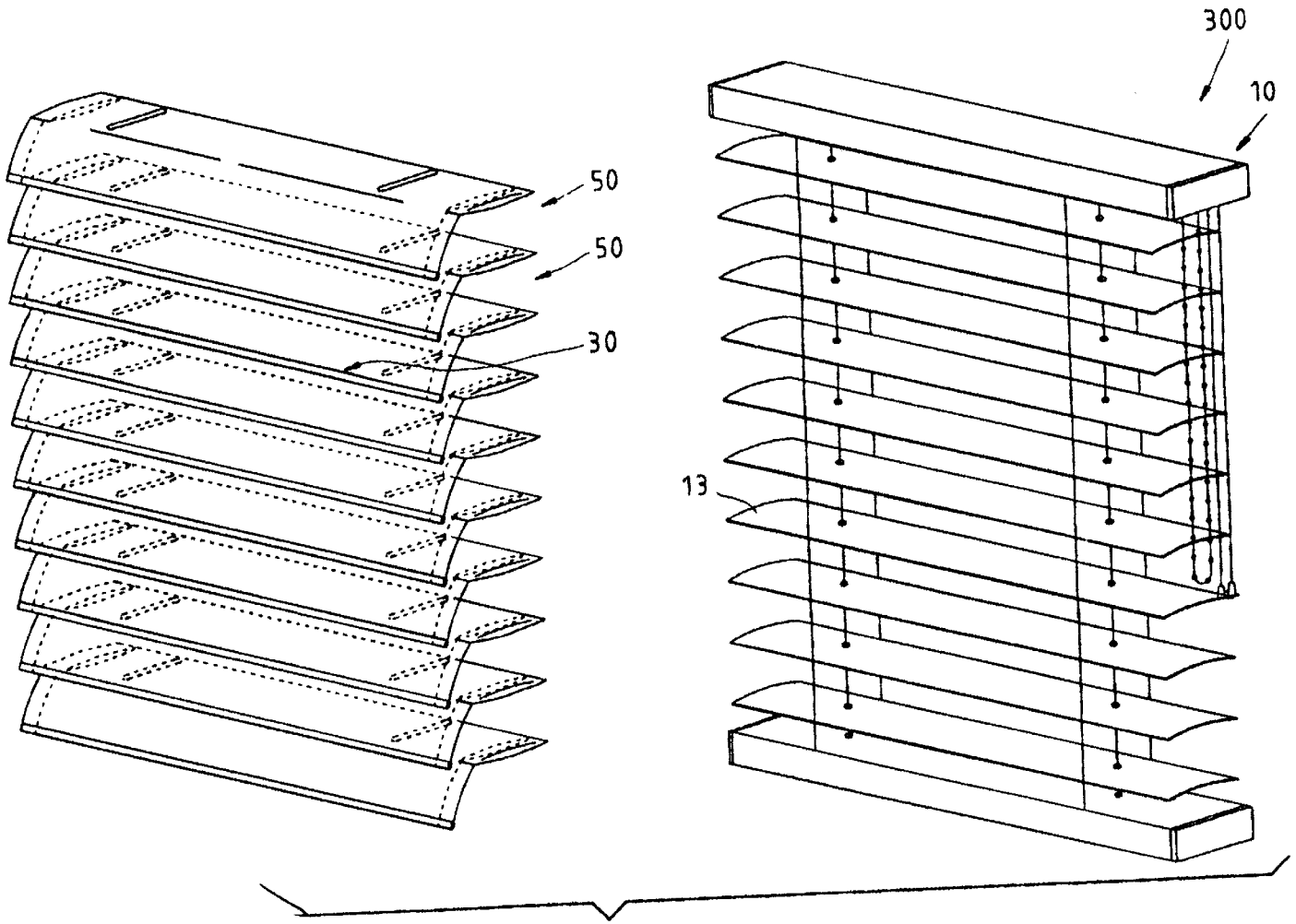
FIG. 8 is an exploded view of a curtain and Venetian blind arrangement constructed according to a third embodiment of the present invention.

FIG. 8 shows a curtain and Venetian blind arrangement 300 according to a third embodiment of the present invention. Similar to the aforesaid first embodiment of the present invention, the curtain and Venetian blind arrangement 300 is comprised of a Venetian blind 10, a number of curtains 50, and a number of weights 30. Unlike the aforesaid first embodiment of the present invention, the number of the curtains 50 is equal to the number of the slats 13, and each slat 13 is covered with a respective curtain 50. The suspension length of each curtain 50 is greater than the pitch between each two slats 13 so that the curtains 50 block the gaps in between the slats 13.

Figure 9:
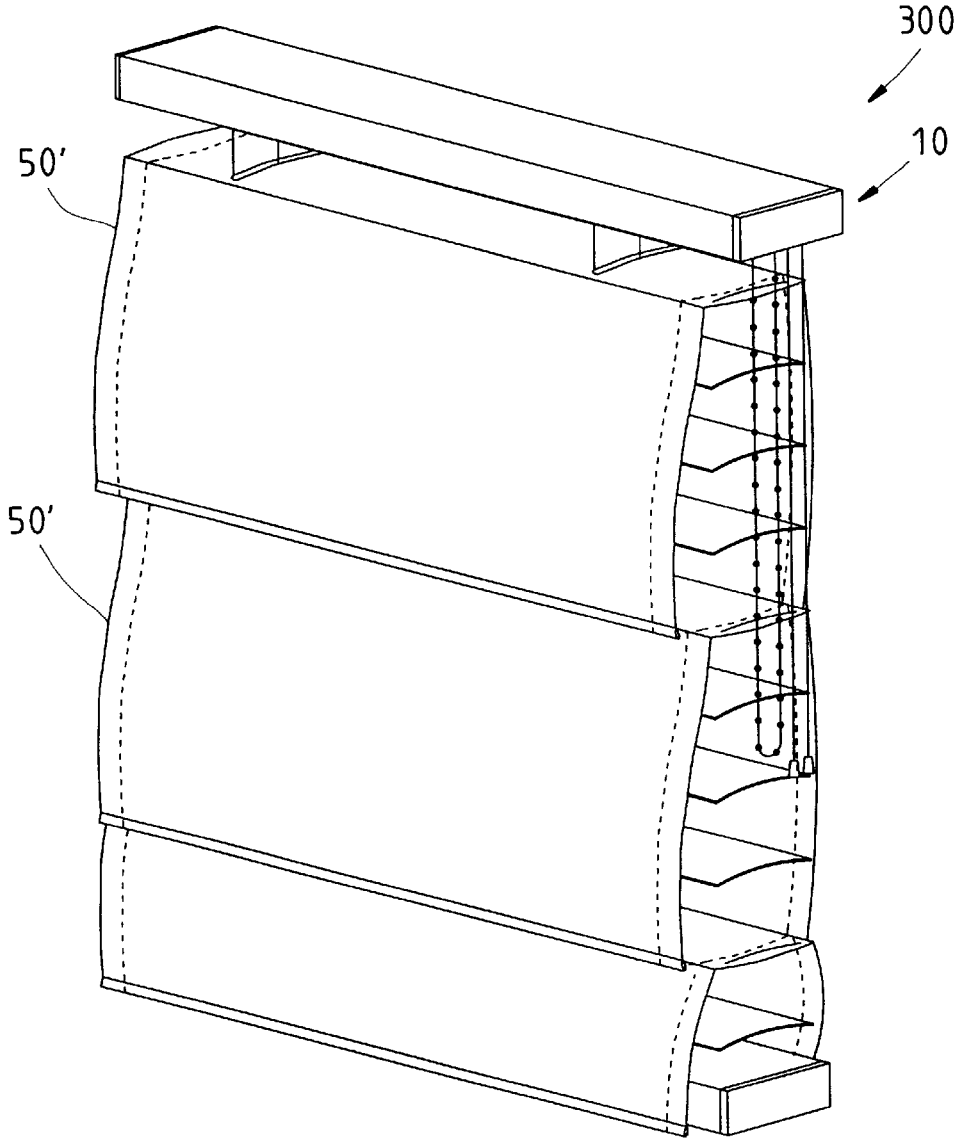
FIG. 9 is a perspective assembly view of a curtain and Venetian blind arrangement constructed according to a fourth embodiment of the present invention.

FIG. 9 shows a fourth embodiment of the present invention. According to this alternate form, the curtains 50' have a respective peripheral side respectively suspended from the slats of the Venetian blind 10, and the suspended peripheral side is relatively longer than that of the aforesaid first, second, and third embodiments of the present invention, i.e., each curtain 50' covers over more than four slats (for example, 4, 5, 6, or 7 pieces of slats). Because the covering area of the curtains 50' is relatively increased, less number of the curtains 50' is required.

Figure 10:
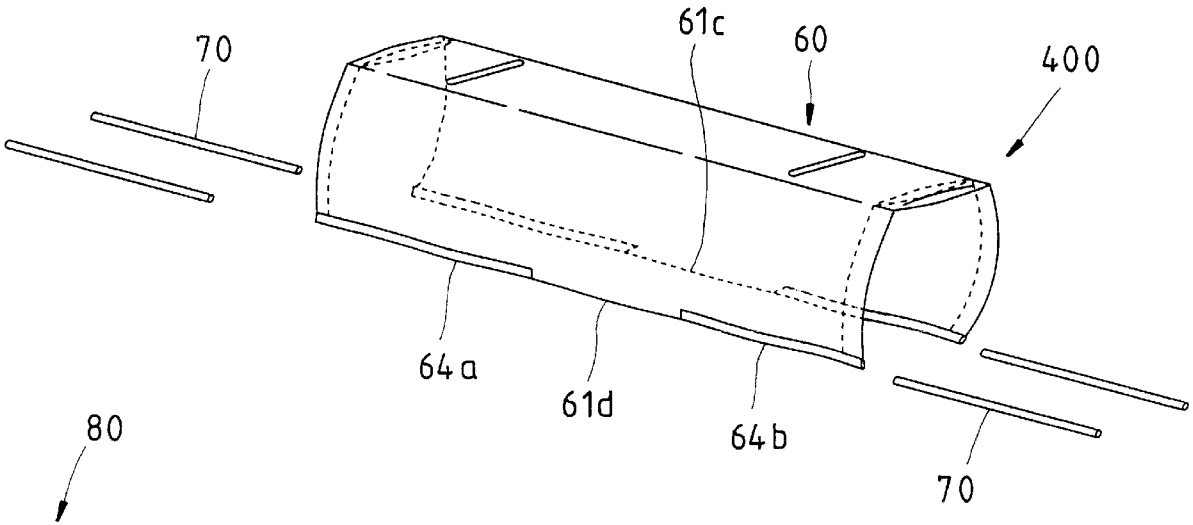
FIG. 10 is a perspective exploded view of a part of a curtain and Venetian blind arrangement constructed according to a fifth embodiment of the present invention.

FIG. 10 shows a curtain and Venetian blind arrangement 400 according to a fifth embodiment of the present invention. Similar to the aforesaid first embodiment of the present invention, the curtain and Venetian blind arrangement 400 is comprised of a Venetian blind (not shown), a number of curtains 60, and a number of weights 70. Unlike the aforesaid first embodiment of the present invention, the third and fourth peripheral sides 61*c*;61*d* of the curtain bodies of the curtains 60 each have two pockets 64*a*;64*b* aligned at two sides and extended along the border, and the rod-like weights 70 are respectively mounted in the pockets 64*a*;64*b* of the curtains 60.

Further, the curtains may be made without the aforesaid through holes for the passing of the lift cord set. In this case, the curtains can be fastened to the slats by fastening means, for example, double-side adhesive, hook and loop materials, bonding agent, etc.

Figure 11:
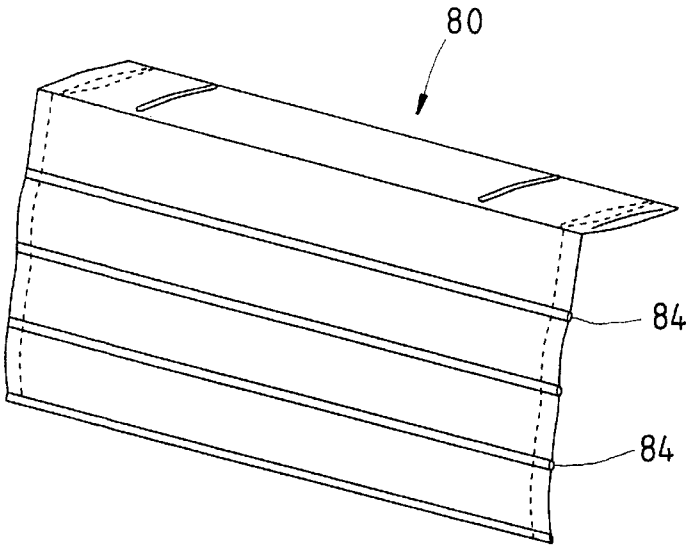
FIG. 11 is a perspective view of a part of a curtain and Venetian blind arrangement constructed according to a sixth embodiment of the present invention.

FIG. 11 shows a sixth embodiment of the present invention. According to this embodiment, each curtain 80 has a number of pockets 84 disposed at different elevations for holding a respective weight.

Further, the weights may be respectively attached to the curtains and then stitch the curtains to secure the weights in position such that the openings of the curtains can be eliminated.

What is claimed is:

1. A curtain and Venetian blind arrangement comprising:

a Venetian blind comprising a headrail, a bottom rail, a plurality of slats positioned between the headrail and the bottom rail, and a lift cord set configured for joining the headrail, the bottom rail and the slats and maintaining the slats to be arranged between the headrail and the bottom rail;

a plurality of curtains coupled to respective ones of the slats, the curtains each having at least one peripheral side suspended from one of said slats and extending towards a lower positioned one of the slats; and wherein the at least one peripheral side of each of the curtains is provided with at least one weight so that the peripheral sides of the curtains are maintained in position.

2. The curtain and Venetian blind arrangement as claimed in claim 1, wherein each of the curtains comprises a first peripheral side and a second peripheral side opposite the first peripheral side, each of the curtains are configured for coupling to one of the slats, a third peripheral side and a fourth peripheral side respectively provided with a respective one of the weights and suspended from one of the slats at two sides thereof.

3. The curtain and Venetian blind arrangement as claimed in claim 2, wherein the first peripheral side and second peripheral side of each of the curtains each has a pocket for respectively receiving two ends of one of the slats.

4. The curtain and Venetian blind arrangement as claimed in claim 3, wherein the first peripheral side and the second peripheral side of each of the curtains are respectively folded inwards and bilaterally stitched, forming the respective pocket on a middle portion thereof.

5. The curtain and Venetian blind arrangement as claimed in claim 1, wherein the at least one peripheral side of each of the curtains comprises a free end provided with at least one pocket for holding the at least one weight.

6. The curtain and Venetian blind arrangement as claimed in claim 5, wherein the pocket at the free end of each of the at least one peripheral side of each of the curtains has a depth approximately equal to the length of the at least one peripheral side of each of the curtains, and the weight is a heavy rod member with length equal to the pocket at a free end of each of the at least one peripheral side of each of the curtains.

7. The curtain and Venetian blind arrangement as claimed in claim 5, wherein the pocket has an opening through which a respective one of the weights is inserted into the pocket.

8. The curtain and Venetian blind arrangement as claimed in claim 1, wherein the length of the at least one peripheral side suspended from one of the slats is greater than the distance between a suspended point thereof to the slat on which an adjacent curtain is attached.

9. The curtain and Venetian blind arrangement as claimed in claim 1, wherein the curtains each have at least one through hole for the passing of the lift cord set therethrough.

* * * * *